US010161090B2

(12) United States Patent
Lee et al.

(10) Patent No.: US 10,161,090 B2
(45) Date of Patent: Dec. 25, 2018

(54) METHOD FOR LAUNCHING/CONSTRUCTING BRIDGE USING ASSEMBLY OF PRECAST BOTTOM PLATE AND CONCRETE-FILLED STEEL TUBE TRUSS GIRDER

(71) Applicant: KOREA RAILROAD RESEARCH INSTITUTE, Uiwang-si, Gyeonggi-do (KR)

(72) Inventors: Kyoung Chan Lee, Goyang-si (KR); In Ho Yeo, Seoul (KR); Sung Il Kim, Yongin-si (KR); Seung Yup Jang, Suwon-si (KR); Hyun-Min Kim, Yongin-si (KR); Ki Hyun Kim, Seoul (KR); Hyang Wook Ma, Seoul (KR); Young Hak Kwak, Yongin-si (KR); Yoon Bong Shin, Seoul (KR); In Gyu Kim, Hwaseong-si (KR); Young Jin Kim, Seongnam-si (KR)

(73) Assignee: Korea Railroad Research Institute, Uiwang-si, Gyeonggi-do (KR)

( * ) Notice: Subject to any disclaimer, the term of this patent is extended or adjusted under 35 U.S.C. 154(b) by 0 days.

(21) Appl. No.: 15/570,726

(22) PCT Filed: Oct. 26, 2015

(86) PCT No.: PCT/KR2015/011324
§ 371 (c)(1),
(2) Date: Oct. 30, 2017

(87) PCT Pub. No.: WO2017/069313
PCT Pub. Date: Apr. 27, 2017

(65) Prior Publication Data

US 2018/0291570 A1 Oct. 11, 2018

(30) Foreign Application Priority Data

Oct. 21, 2015 (KR) ..... 10-2015-0146405

(51) Int. Cl.
*E01D 21/06* (2006.01)
*E01D 19/12* (2006.01)
*E01D 6/00* (2006.01)

(52) U.S. Cl.
CPC ..... *E01D 21/06* (2013.01); *E01D 6/00* (2013.01); *E01D 19/125* (2013.01)

(58) Field of Classification Search
CPC ..... E01D 6/00; E01D 2101/24; E01D 21/06; E01D 21/065
(Continued)

(56) References Cited

U.S. PATENT DOCUMENTS 4,993,094 A * 2/1991 Muller ..... E01D 2/04 14/18
5,617,599 A * 4/1997 Smith ..... E01D 19/125 14/73

(Continued)

FOREIGN PATENT DOCUMENTS

JP 2003-193430 A 7/2003
KR 10-2011-0023334 A 3/2011

(Continued)

OTHER PUBLICATIONS

PCT International Search Report, PCT/KR2015/011324, dated Sep. 1, 2016, 4 Pages.

*Primary Examiner* — Gary S Hartmann
(74) *Attorney, Agent, or Firm* — Fenwick & West LLP

(57) ABSTRACT

A method for launching/constructing a bridge using assembly of a precast bottom plate and a concrete-filled steel tube truss girder, wherein a CFT truss girder and a precast bottom plate are provisionally assembled, thereby forming a segment, and then a plurality of segments are successively launched, thereby constructing a bridge.

8 Claims, 21 Drawing Sheets

(58) Field of Classification Search
USPC ..... 14/4, 13, 77.1
See application file for complete search history.

(56) References Cited

U.S. PATENT DOCUMENTS

| | | | | | |
|---|---|---|---|---|---|
| 5,802,652 | A * | 9/1998 | Smith | E01D 19/125 | 14/73 |
| 5,978,997 | A * | 11/1999 | Grossman | E01D 2/02 | 14/73 |
| 7,546,656 | B2 * | 6/2009 | Kim | E01D 2/00 | 14/75 |
| 7,669,272 | B2 * | 3/2010 | Powers | E01D 21/06 | 14/77.1 |

FOREIGN PATENT DOCUMENTS

| | | | |
|---|---|---|---|
| KR | 10-2011-0041144 | A | 4/2011 |
| KR | 10-2011-0126866 | A | 11/2011 |
| KR | 10-1245620 | B1 | 3/2013 |
| KR | 10-2013-0141275 | A | 12/2013 |

* cited by examiner

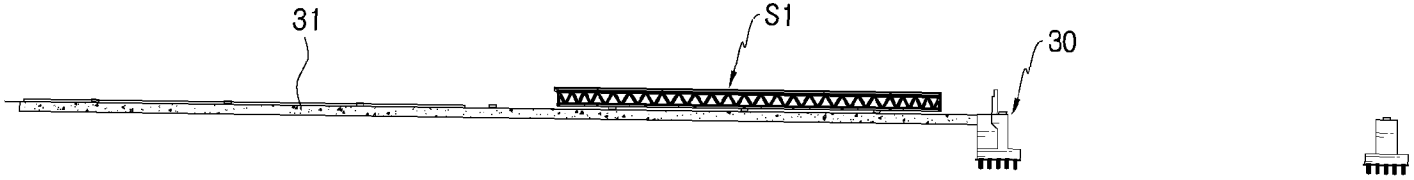
[Fig 1A]

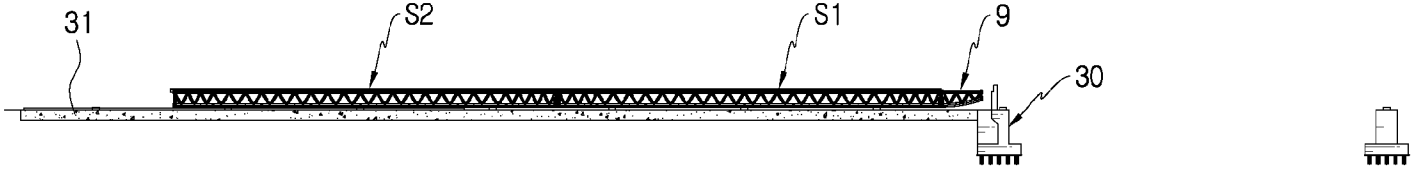
[Fig 1B]

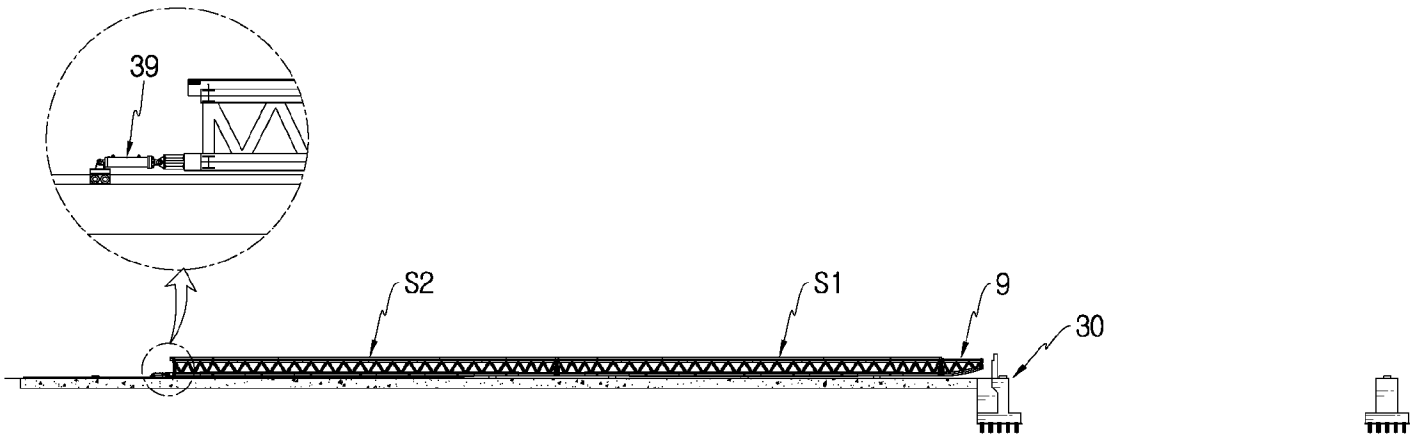
[Fig 2A]

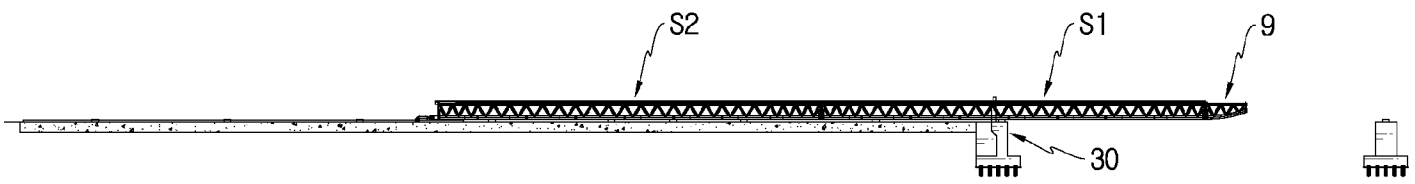
【Fig 2B】

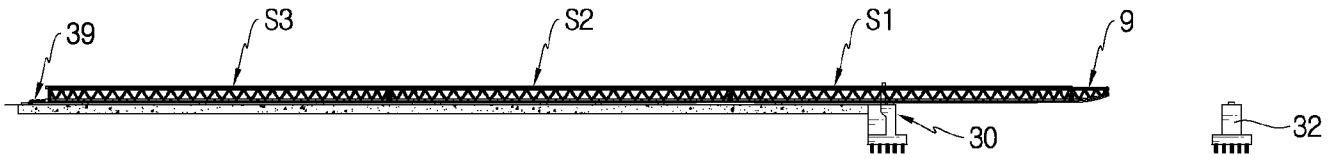
【Fig 3A】

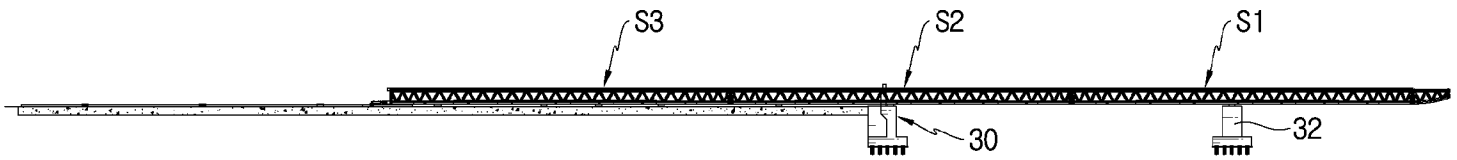
【Fig 3B】

【Fig 4】
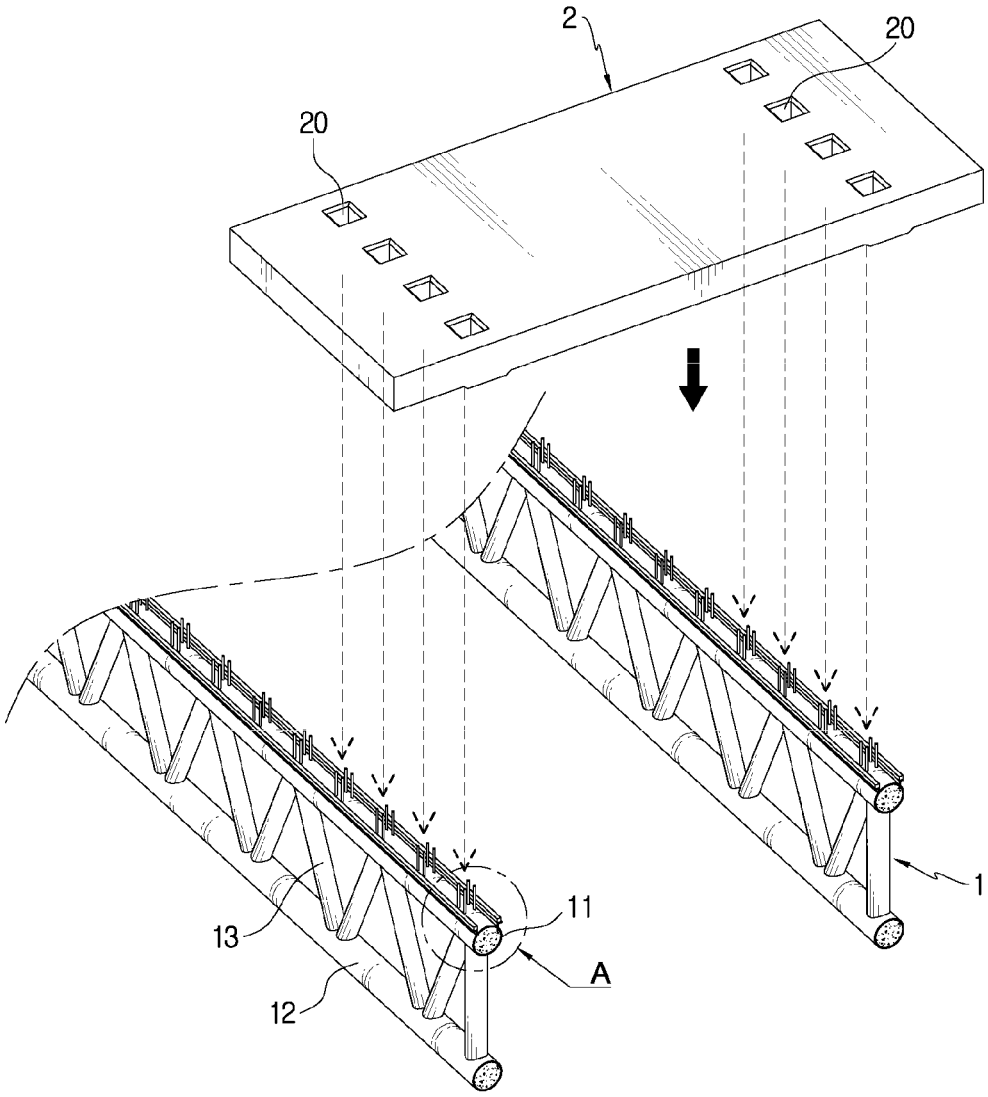

【Fig 5】
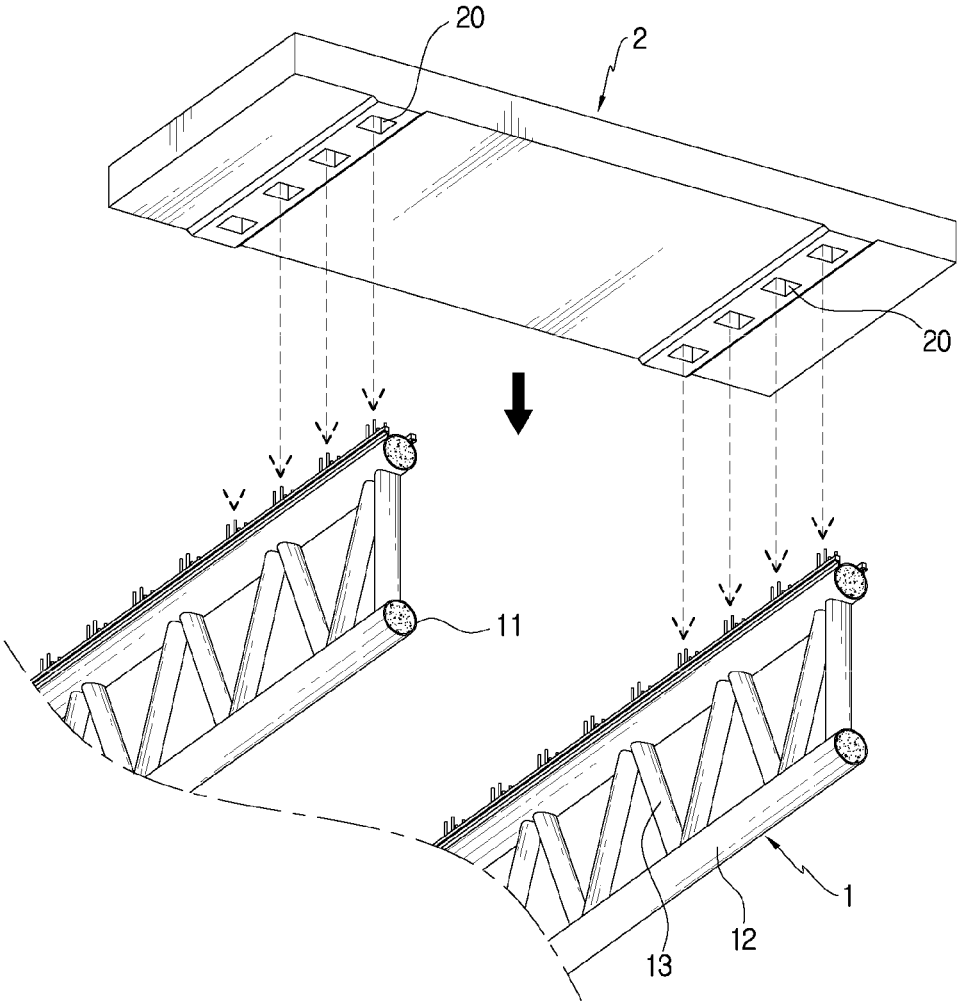

【Fig 6】
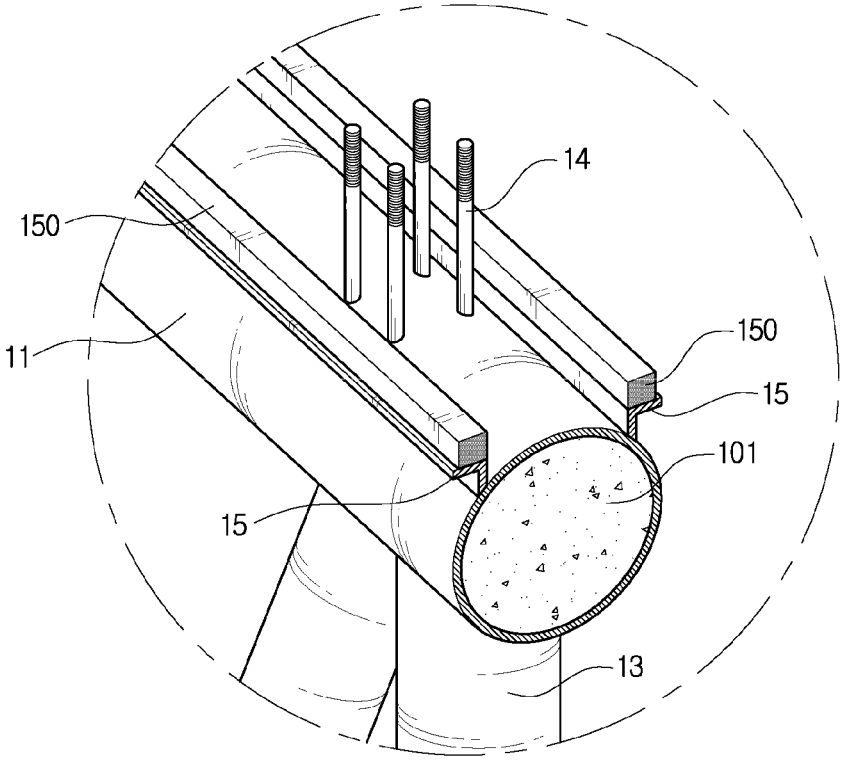

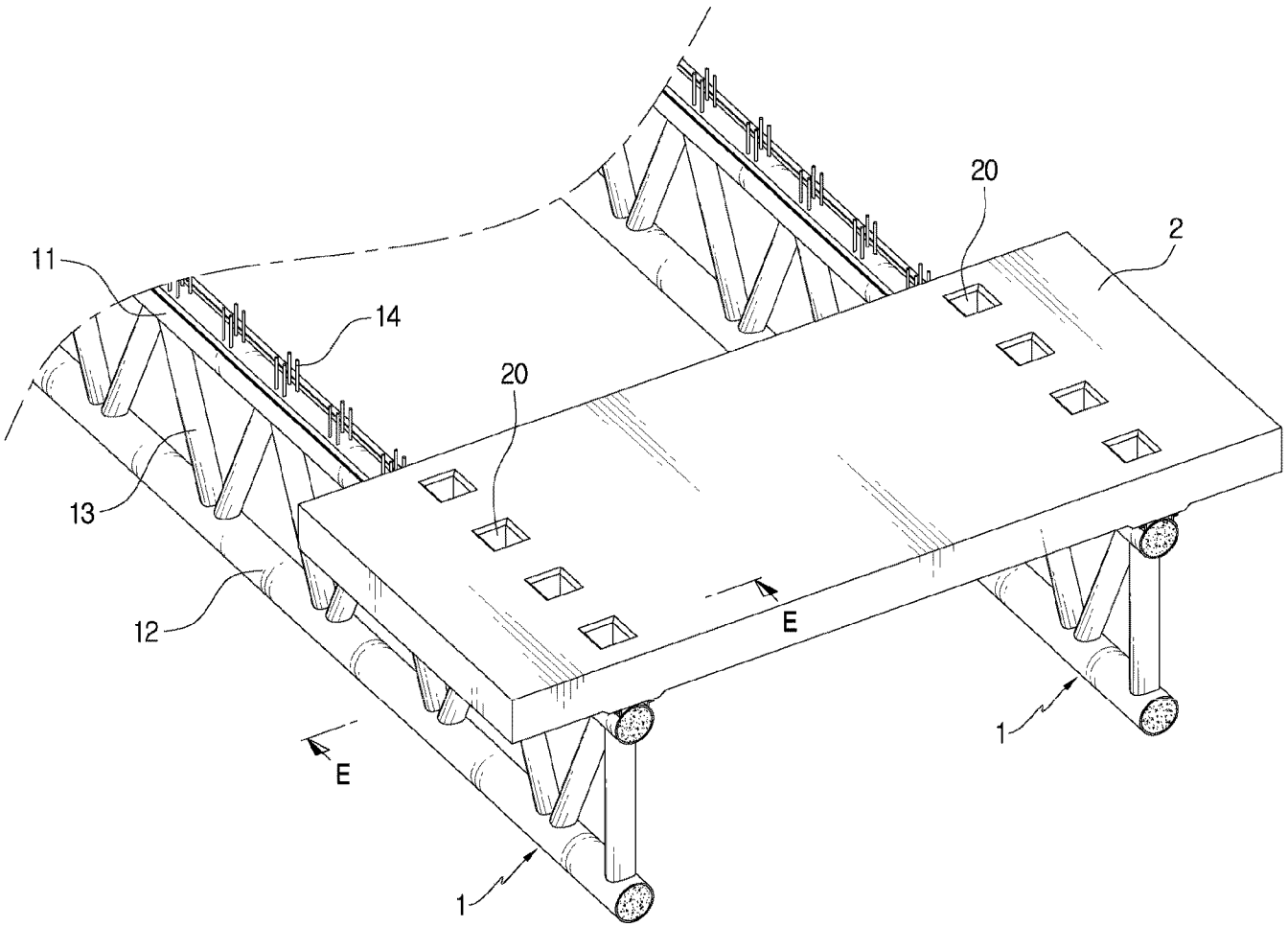
【Fig 7】

【Fig 8】
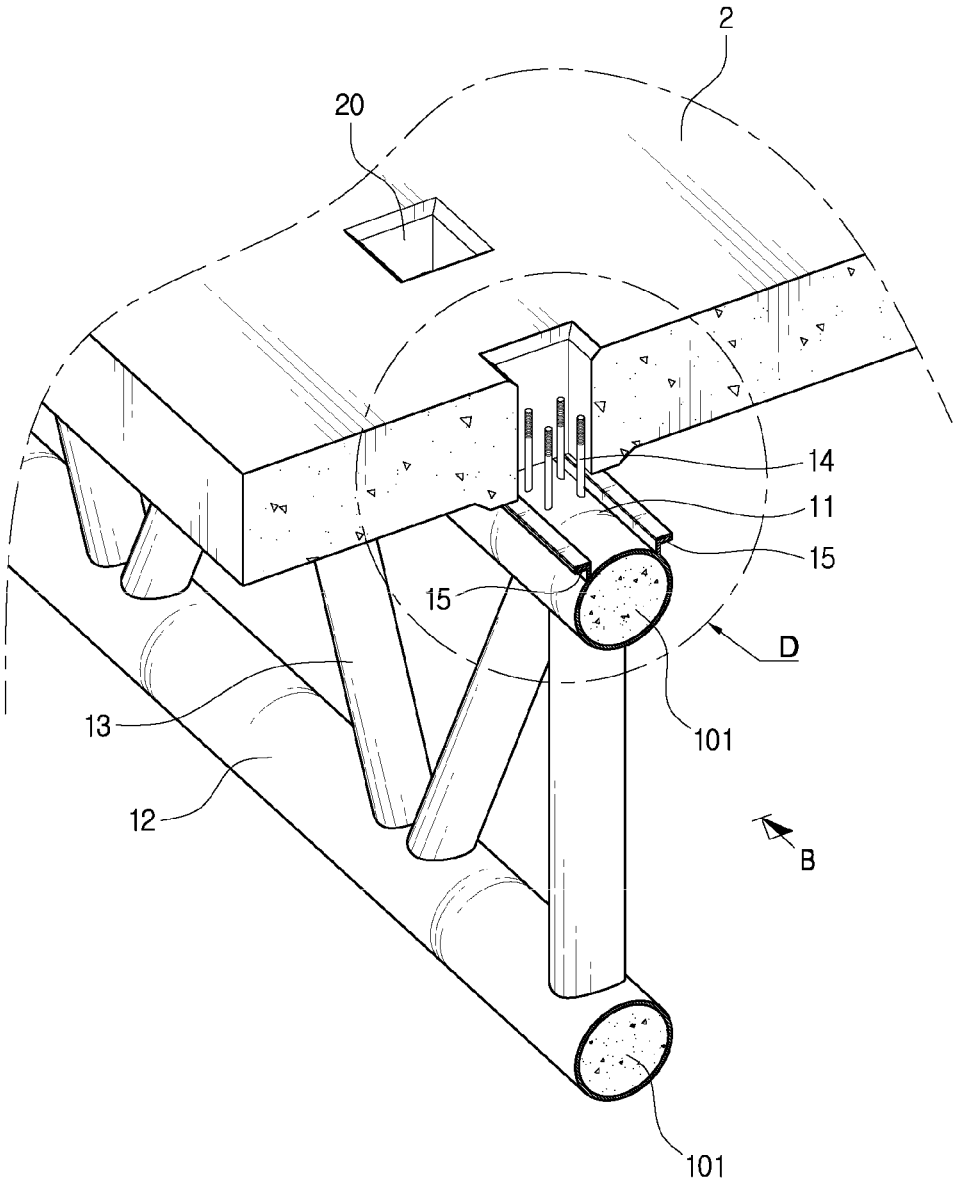

【Fig 9】
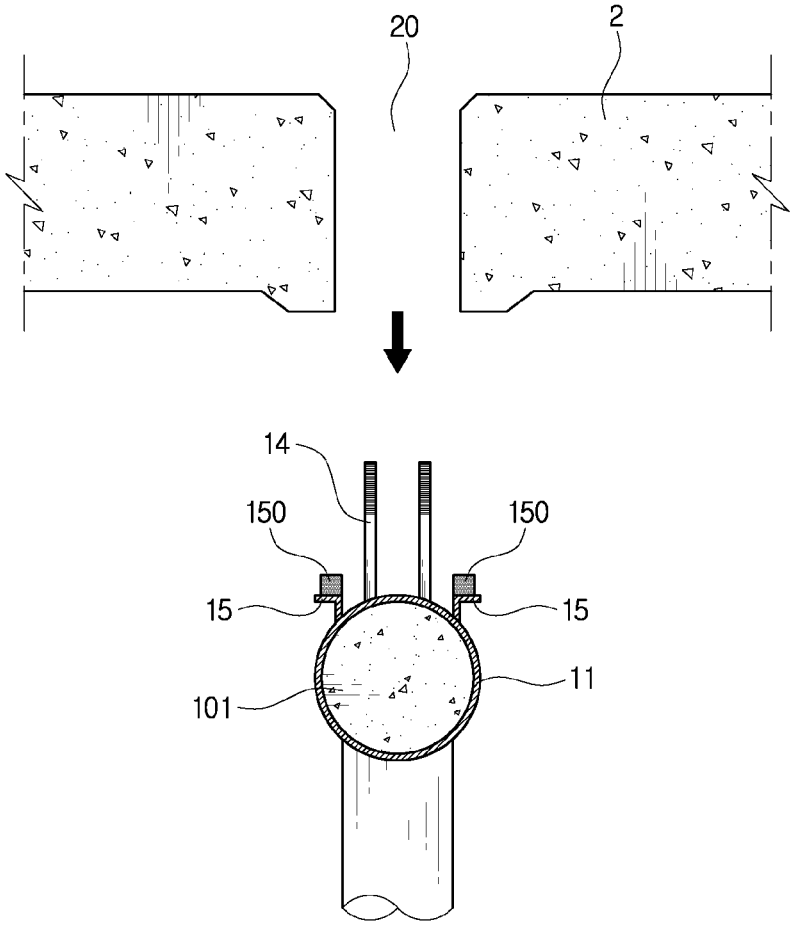

【Fig 10】
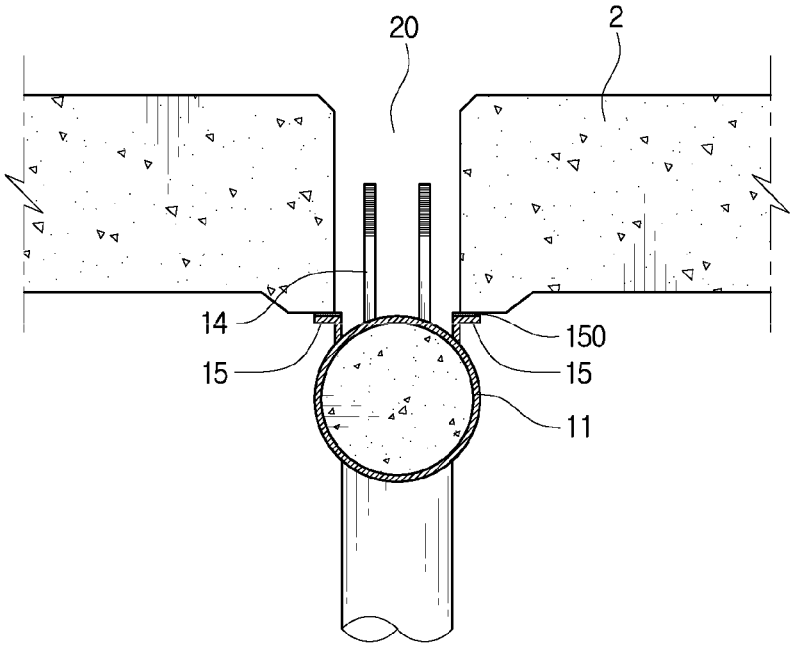
【Fig 11】
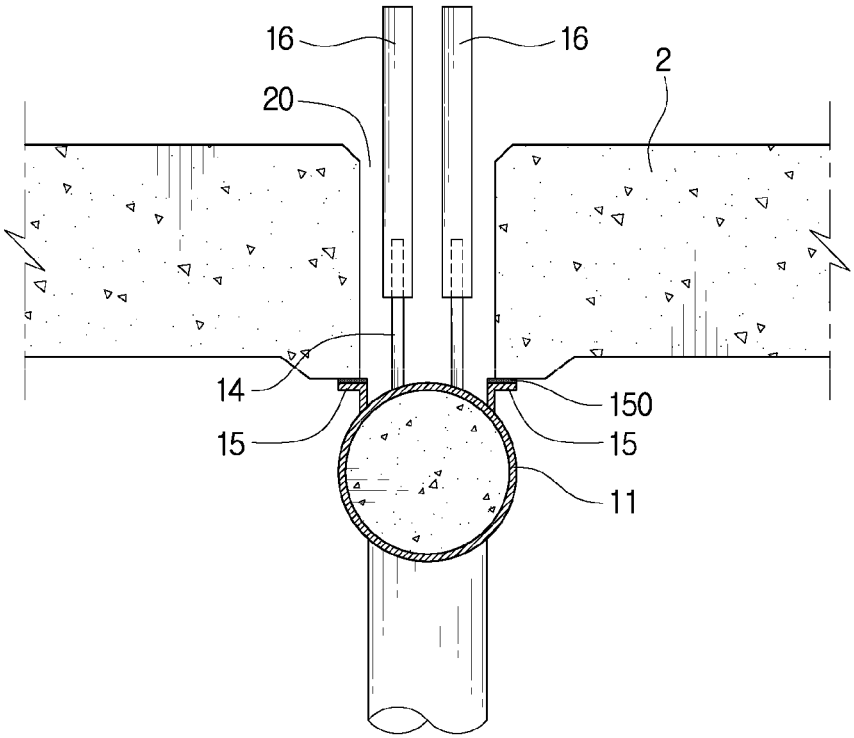

【Fig 12】
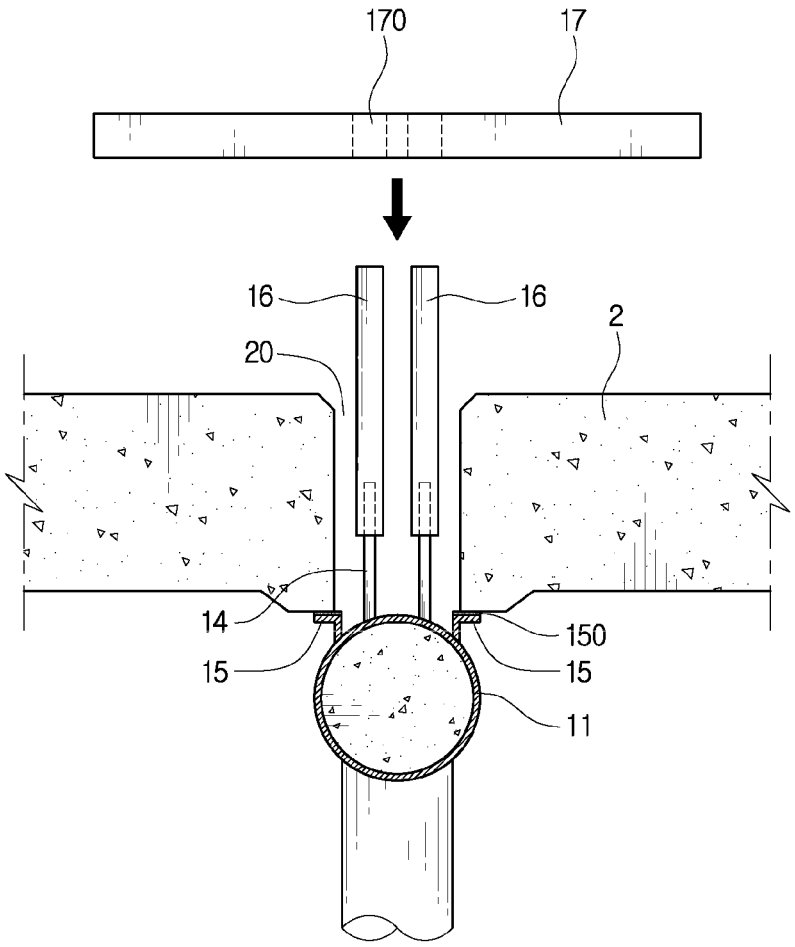

【Fig 13】
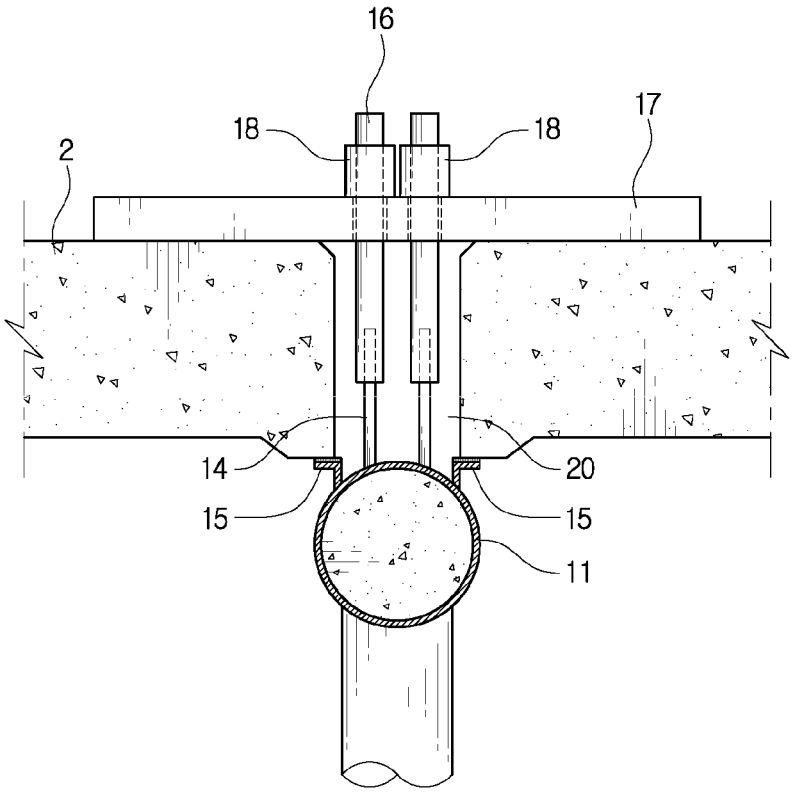

【Fig 14】
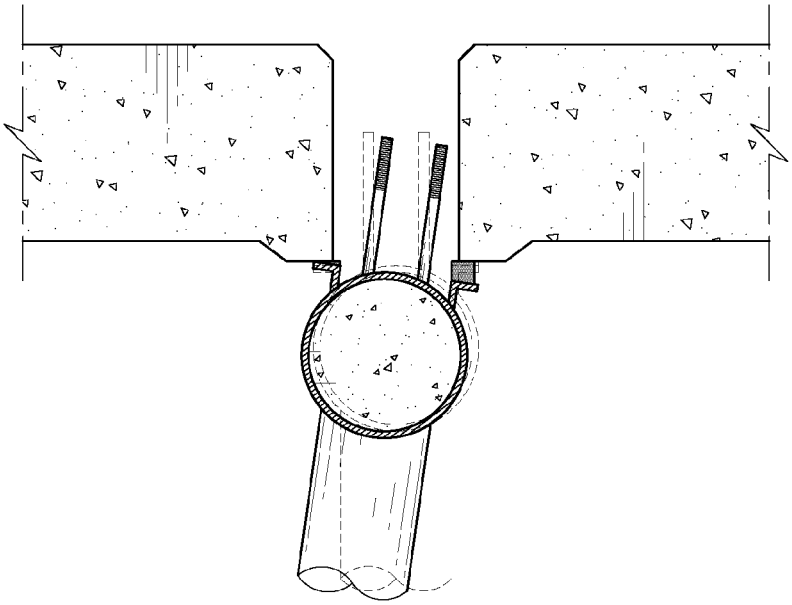
【Fig 15】
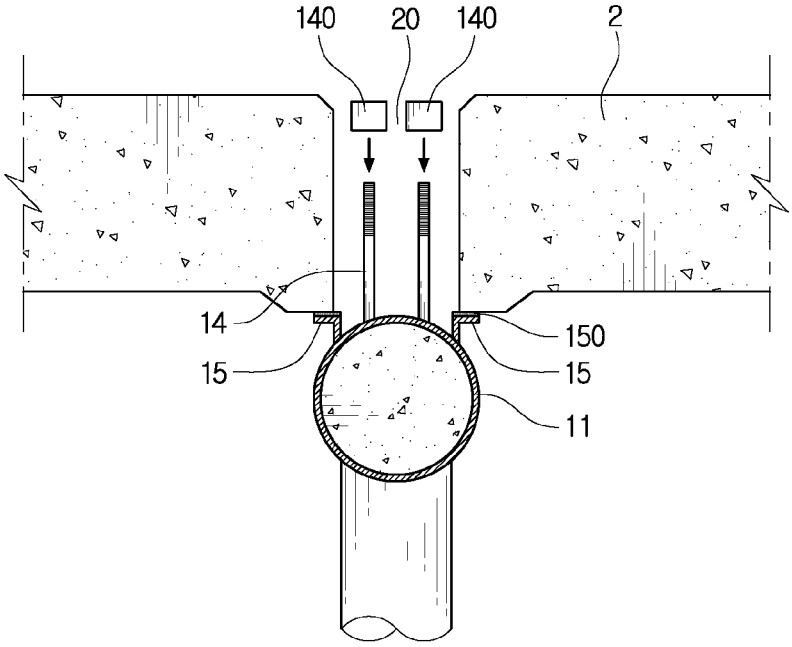

【Fig 16】
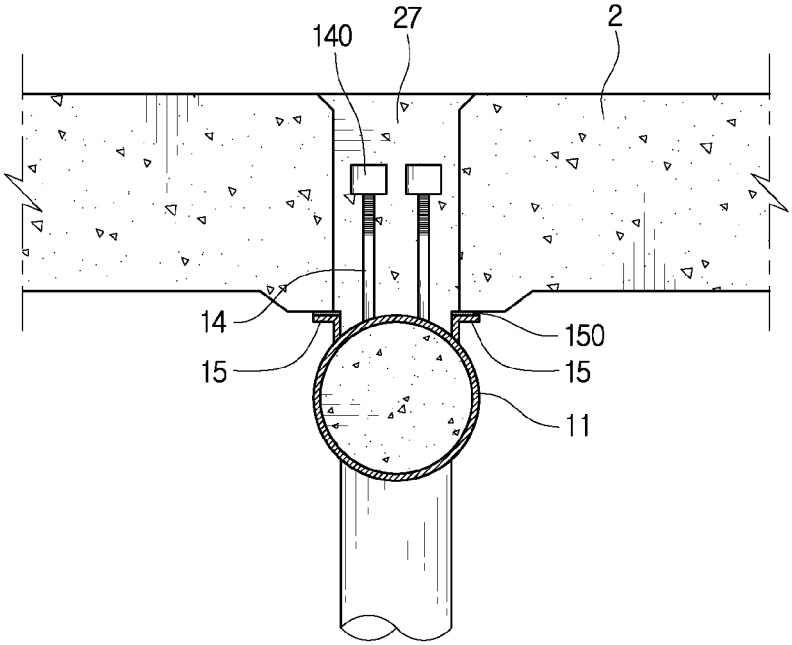

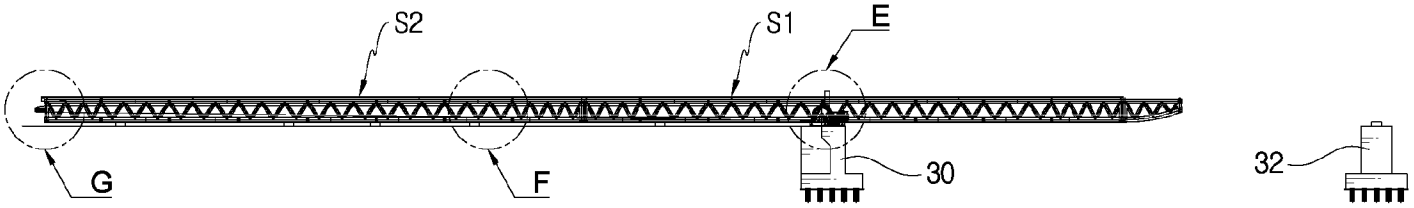
【Fig 17】

【Fig 18】
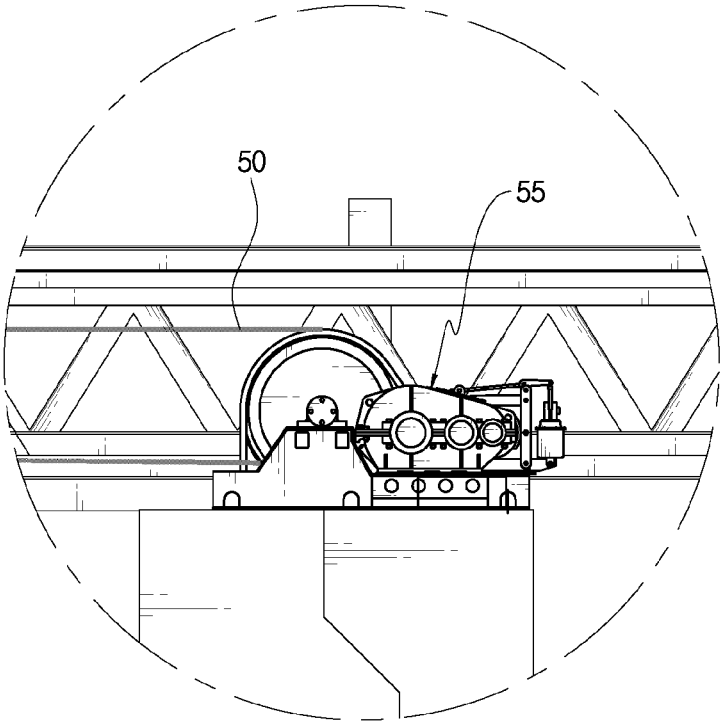

【Fig 19】
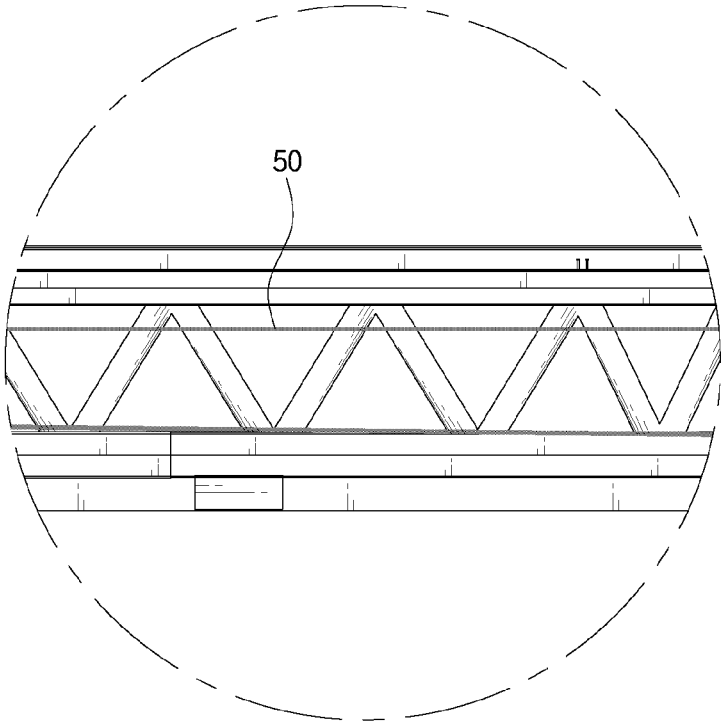

【Fig 20】
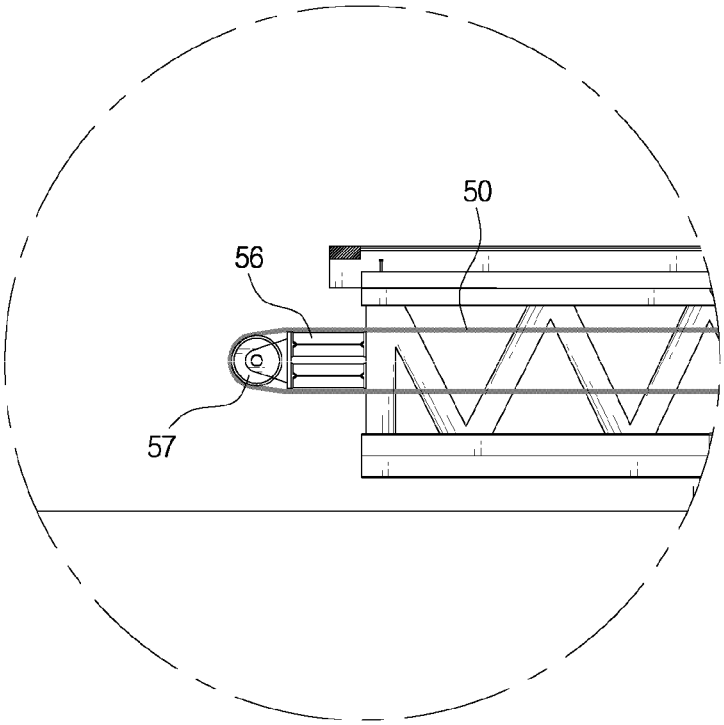

METHOD FOR LAUNCHING/CONSTRUCTING BRIDGE USING ASSEMBLY OF PRECAST BOTTOM PLATE AND CONCRETE-FILLED STEEL TUBE TRUSS GIRDER

TECHNICAL FIELD

This disclosure relates to a method for constructing a bridge by launching a superstructure. The present disclosure relates to a "launching method of a composite concrete filled steel tube (CFT) truss girder bridge", which is constructed by temporarily assembling the CFT truss girder and a precast concrete slab to form a "segment" and then launching a plurality of segments in sequence.

BACKGROUND ART

A CFT truss girder is a girder constructed by concrete filled steel tubes (CFTs), each being prepared by filling concrete in a steel tube, in a truss structure. An incremental launching method (hereinafter, referred to as "ILM") has been used for constructing a bridge. In the ILM, a plurality of segment units, which will configure a superstructure of a bridge, is pre-fabricated at a casting bed built at the rear of an abutment, and then the segment units are pushed in a bridge axis direction in order by using an extrusion device such as a jack device to construct a bridge.

When constructing a bridge using the CFT truss girder and the concrete slab, it is desirable to use the ILM. However, an existing ILM has following problems, and these problems should be solved.

When a superstructure of a bridge, composed of a steel girder and a precast concrete slab, is constructed by means of an existing ILM, a unit of a superstructure should be completely pre-fabricated with a steel girder and an in-situ concrete slab before launching the unit. Thus, the existing technique has a drawback in an extended construction period. In addition, in the existing technique, while units of the superstructure are being launched in sequence, in order to offset a tensile stress applied to the concrete slab, a prestressing force should be continuously introduced to the concrete slab throughout the launching process. Thus, construction costs may be increased.

In the existing ILM, a steel girder may be launched in advance. However, in this case, a concrete slab should be fabricated with the steel girder by placing concrete in-site, and thus the extended construction period is not shortened. In addition, after the steel girder is launched, when the concrete slab is fabricated with the steel girder by placing concrete in-site, the fabrication work should be performed at a high place, which deteriorates construction efficiency and safety. Therefore, in order to construct a bridge having a superstructure bridge with a CFT truss girder and a concrete slab by means of the ILM, it is needed to solve the problems of the existing ILM as mentioned in the above.

DISCLOSURE

Technical Problem

This disclosure is designed to overcome the limit of the above existing technique. The present disclosure is directed to shortening a construction period, improving construction efficiency and ensuring improved safety during a construction process by minimizing works at the bridge construction site, when a bridge is constructed to have a superstructure with a CFT truss girder and a concrete slab by means of the ILM.

In addition, the present disclosure is directed to effectively suppressing a lateral torsional buckling caused at the girder and to ensuring stability for the lateral torsional buckling. In addition, the present disclosure is directed to preventing an excessive tensile force from being applied to a precast concrete slab during a launching process so that the concrete slab is not damaged due to the tensile force.

Technical Solution

In one general aspect, there is provided a launching method of a bridge, which constructs a bridge to have a superstructure composed of a concrete filled steel tube (CFT) truss girder and a precast concrete slab, the launching method comprising: placing a precast concrete slab on a CFT truss girder at a casting bed to fabricate a segment including the CFT truss girder and the precast concrete slab in a temporarily assembled state, successively disposing segments to connect CFT truss girders integrally with each other, and launching the segments in order in a front direction to form a superstructure of a bridge; and after the segments are completely launched, integrally composing the CFT truss girders and the precast concrete slabs, wherein a prestressing force is applied to the precast concrete slabs in a longitudinal direction so that the precast concrete slabs are integrated with each other.

In the launching method of a bridge, a plurality of precast concrete slabs is successively disposed in a longitudinal direction at a single segment, and after the segments are completely launched, when the CFT truss girders and the precast concrete slabs are integrally composed, a prestressing force is applied to the plurality of precast concrete slabs in a longitudinal direction so that the precast concrete slabs are integrated with each other.

The CFT truss girder includes an upper beam, a lower beam, and a web beam connecting the upper and lower beams. Support members may be provided at an upper surface of the upper beam to support the precast concrete slab. A shear pocket may formed with a through hole is formed in the precast concrete slab at a location placed on the upper beam of the CFT truss girder and a stud inserted into the shear pocket is provided at the upper beam. Further, the process of temporarily assembling the CFT truss girder and the precast concrete slab by placing the precast concrete slab on the CFT truss girder includes placing the precast concrete slab on the support member so that the stud is inserted into the shear pocket, and coupling an extension rod to an upper portion of the stud and installing an anchor plate on an upper surface of the precast concrete slab so that the upper portion of the extension rod is coupled to the anchor plate.

In the launching method of a bridge, the process of integrally composing the CFT truss girders and the precast concrete slabs may include removing the extension rod and the anchor plate, and placing a grouting material in the shear pocket at which the stud is located so that the grouting material fills the upper space of the upper beam and the shear pocket and is cured. A through hole may be formed in the anchor plate so that the extension rod passes therethrough. The process of coupling the upper portion of the extension rod to the anchor plate may include placing the anchor plate on the shear pocket in a state where the extension rod is coupled to the stud so that the upper portion of the extension rod is inserted into the through hole and thus the anchor plate passing through the anchor plate is placed on the upper surface of the precast concrete slab, and coupling a coupling member to the extension rod protruding on an upper surface of the anchor plate to press the anchor plate toward the upper surface of the precast concrete slab.

In the launching method of a bridge, when the CFT truss girder and the precast concrete slab are integrally composed, after the extension rod and the anchor plate are removed, a head portion is coupled to a top of the stud, and then the grouting material is placed in the shear pocket.

In the launching method of a bridge, the process of fabricating segments and launching the segments in order in a front direction to form a superstructure of a bridge may include placing a precast concrete slab on a CFT truss girder and temporarily assembling the precast concrete slab and the CFT truss girder to fabricate a first segment; temporarily assembling a CFT truss girder and a precast concrete slab to fabricate a second segment, and disposing the second segment at the rear of the first segment to connect the CFT truss girders of the first and second segments; pushing the first and second segments to be launched in a front direction; and fabricating an additional segment by temporarily assembling a CFT truss girder and a precast concrete slab, disposing the additionally fabricated segment at the rear of the segment located at a rearmost side, connecting CFT truss girders of the segments, and then pushing the segments to be launched in a front direction.

In the launching method of a bridge, a winch is installed at an abutment of the bridge. In the process of pushing the segments to be launched in a front direction, a cross beam having a pulley is installed at a rear end of the segment located at a rearmost side, a wire is wound around the pulley, and the winch winds the wire to pull the wire so that the segment is moved forwards.

Advantageous Effects

According to the present disclosure, a long-span bridge having a lightweight superstructure composed of a CFT truss girder and a precast concrete slab may be constructed.

In particular, in the present disclosure, since main members of the superstructure of a bridge are pre-fabricated at a factory, works at the bridge construction site may be minimized, and thus it is possible to greatly shorten a construction period required for constructing the bridge, improve construction efficiency by means of mechanized construction, and ensure safety during a construction process.

In addition, in the present disclosure, a precast concrete slab suppresses a lateral torsional buckling caused at the CFT truss girder while the superstructure of the bridge is being launched, and thus excellent stabilization may be ensured against the lateral torsional buckling.

Moreover, in the present disclosure, while the superstructure of the bridge is being launched, it is possible to prevent an excessive tensile force from being applied to the precast concrete slab, and thus it is possible to effectively prevent the precast concrete slab from being damaged due to a tensile force.

DESCRIPTION OF DRAWINGS

FIGS. 1A to 3B are schematic side views for illustrating processes of a bridge launching construction method according to an embodiment of the present disclosure, respectively.

FIGS. 4 and 5 are schematic exploded perspective views showing a state where a precast concrete slab is placed on a CFT truss girder in the present disclosure, observed in different directions.

FIG. 6 is a schematic enlarged view showing a circle portion A of FIG. 4.

FIG. 7 is a schematic perspective view showing a state where the precast concrete slab is placed on the CFT truss girder in the present disclosure.

FIG. 8 is a schematic perspective view showing the precast concrete slab, which is sectioned along a line E-E in FIG. 7.

FIGS. 9 to 13 are schematic longitudinal sectional views showing a circle portion D of FIG. 8 in the present disclosure, observed in a direction of an arrow B.

FIG. 14 is a schematic sectional view corresponding to FIG. 10, showing a state where an upper beam is rotated due to lateral torsional buckling.

FIG. 15 is a schematic sectional view corresponding to FIG. 10, showing a state where a head portion is assembled to a stud in the present disclosure.

FIG. 16 is a schematic sectional view corresponding to FIG. 10, showing a state where the stud is buried in a grouting material within a shear pocket in the present disclosure.

FIG. 17 is a schematic side view corresponding to FIG. 2B, showing that a segment is launched in a front direction by using a wire.

FIG. 18 is a schematic enlarged view showing a circle portion E of FIG. 17.

FIG. 19 is a schematic enlarged view showing a circle portion F of FIG. 17.

FIG. 20 is a schematic enlarged view showing a circle portion G of FIG. 17.

BEST MODE

Hereinafter, an embodiment of the present disclosure will be described with reference to the accompanying drawings. Even though the present disclosure is described based on the embodiment depicted in the drawings, this is just an embodiment, and the technical features, essential configurations and operations of the present disclosure are not limited thereto. For reference, in the present disclosure, a direction for pushing a segment toward a bridge pier at an abutment along a bridge axis is described as a "front direction", and its opposite direction is described as a "rear direction". In addition, a bridge axis direction is described as "a longitudinal direction", and a bridge transverse direction is described as a "transverse direction".

FIGS. 1A to 3B are schematic side views for illustrating processes of a bridge launching construction method according to an embodiment of the present disclosure. As shown in FIG. 1A, at a casting bed 31 formed at the rear of an abutment 30, a concrete filled steel tube (CFT) truss girder 1 is prepared in a predetermined length. A precast concrete slab 2 is placed on the CFT truss girder 1, and the precast concrete slab 2 is "temporarily assembled" with the CFT truss girder to produce a<first segment> S1 (Step 1). In this way, in the bridge launching construction of the present disclosure, the precast concrete slab 2 and the CFT truss girder 1, which are main members of a bridge, are pre-fabricated at a casting bed before launching, and thus it is possible to improve construction quality and ensure consistent member quality in comparison to an existing technique in which concrete is placed at the bridge construction site.

Then, as shown in FIG. 1B, another segment, i.e. <second segment> S2 produced by temporarily assembling a CFT truss girder 1 and a precast concrete slab 2, is successively disposed at a rear end of the first segment S1, and the second segment S2 is integrated with the first segment S1 (Step 2).

The second segment S2 is pre-fabricated by placing a precast concrete slab 2 manufactured in advance at a factory on a CFT truss girder 1 and then "temporarily assembling" them, similar to the first segment S1. Additional segments installed at the rear of the second segment S2 are also fabricated in the same way as the first and second segments S1, S2 as described above.

During fabricating the segments as described above, only the CFT truss girders 1 are integrally connected to each other. In other words, when the second segment S2 is successively disposed at the rear of the first segment S1 and then the first and second segments S1, S2 are integrally connected, the precast concrete slabs 2 are not yet integrally connected, but only the CFT truss girder of the first segment S1 is integrally connected with the CFT truss girder of the second segment S2. The CFT truss girders may be integrally connected in various ways, for example by means of welding. When the second segment S2 is disposed at the rear of the first segment S1 and is connected thereto, a launching nose 9 is installed at the front of the first segment S1 and is connected thereto. The launching nose 9 is a member generally used in an incremental launching method (ILM) and thus is not described in detail here.

In a state where a plurality of segments is successively disposed and integrated as described above at a casting bed in a bridge axis direction, the segments are extruded forwards (Step 3). For this, as shown in FIG. 2A, an extrusion jack 39 is installed at the rear of a segment located at a rearmost side and is operated so that the plurality of segments (the first segment and the second segment in this embodiment depicted in the drawings) are pushed forwards to be launched to a predetermined location as shown in FIG. 2B.

Then, as shown in FIG. 3A, a<third segment S3> is successively disposed at the rear of the <second segment S2> which is still located at the casting bed, and the third segment S3 is integrally connected to the second segment S2 (Step 4). The third segment S3 is also prepared by temporarily assembling a CFT truss girder 1 and a precast concrete slab 2. Then, as shown in FIG. 3B, an extrusion jack 39 is installed at the rear of the third segment S3 and is operated so that the plurality of segments (the first segment, the second segment and the third segment in this embodiment depicted in the drawings) successively disposed are moved forwards to be launched to a predetermined location (Step 5).

A series of processes for successively disposing a new segment at the rear of a rearmost segment among the segments launched forwards and integrally connecting thereto, and then installing an extrusion jack 39 thereto and operating to launch the segments forwards is repeated so that a plurality of segments is successively disposed all over the entire span of a designed bridge (Step 6).

While the plurality of segments is successively disposed all over the entire span of the designed bridge and is supported by bridge piers 32, in each segment, the CFT truss girder 1 and the precast concrete slab 2 are still in a temporarily assembled state. In other words, the CFT truss girder 1 and the precast concrete slab 2 are not yet perfectly integrally composed with each other. In addition, the precast concrete slabs 2 of the segments are not yet integrally composed with each other in a bridge axis direction. Therefore, after the plurality of segments is successively disposed all over the entire span of the designed bridge, in each segment, the CFT truss girder 1 and the precast concrete slab 2 are integrally composed, and in a bridge axis direction, the precast concrete slabs 2 of the segments are also integrally composed with each other (Step 7).

In the bridge launching construction method of the present disclosure, the segments are launched in a state where the precast concrete slab 2 is "temporarily assembled" to the CFT truss girder 1, and the CFT truss girder 1 and the precast concrete slab 2 are integrally composed after the segments are completely launched all over the entire span of the bridge. Now, a structure and method for temporarily assembling the CFT truss girder 1 and the precast concrete slab 2 will be described. In addition, a structure and method for integrally composing the CFT truss girder 1 and the precast concrete slab 2 will be described.

FIGS. 4 and 5 are schematic exploded perspective views showing a state where the precast concrete slab 2 is placed on the CFT truss girder 1, observed in different directions, and FIG. 6 is a schematic enlarged view showing a circle portion A of FIG. 4 which depicts an upper portion of an upper beam 11 of the CFT truss girder 1. As shown in the figures, the CFT truss girder 1 includes an upper beam 11 and a lower beam 12 extending in a bridge axis direction and disposed in parallel to each other. Further, the CFT truss girder 1 includes web beams 13 connecting the upper and lower beams 11, 12. The upper beam 11, the lower beam 12 and the web beams 13 are configured to have a steel tube filled with concrete 101. The upper beam 11 and the lower beam 12 are respectively located at upper and lower portions of the CFT truss girder in a vertical direction. In the present disclosure, a plurality of CFT truss girders 1 is disposed in parallel at intervals in a bridge transverse direction. In the embodiment depicted in the drawings, two CFT truss girders 1 are provided.

The precast concrete slab 2 is a rectangular concrete slab with a predetermined thickness. The precast concrete slab 2 is installed on the CFT truss girder 1 to configure a segment. In a single segment, a length of the precast concrete slab 2 in a bridge axis direction may be identical to a length of the CFT truss girder 1 in a bridge axis direction. However, in a single segment, a length of the precast concrete slab 2 in a bridge axis direction may be smaller than a length of the CFT truss girder 1 in a bridge axis direction. In this case, in a single segment, a plurality of precast concrete slabs 2 is successively located in a bridge axis direction and installed on the CFT truss girder 1. In addition, when forming a single segment, a plurality of precast concrete slabs 2 may be successively disposed in a longitudinal direction. In a single segment, a plurality of precast concrete slabs 2 may be successively disposed in a longitudinal direction on the upper beams 11 of the CFT truss girders 1 successively disposed in a longitudinal direction.

The precast concrete slab 2 is placed on the upper beam 11 of the CFT truss girder 1. The precast concrete slab 2 has a shear pocket 20 at a location where the precast concrete slab 2 is placed on the upper beam 11. The shear pocket 20 is a through hole formed through the precast concrete slab 2 in a thickness direction thereof. A plurality of shear pockets 20 is formed at intervals in a bridge axis direction.

At the upper surface of the upper beam 11, a vertical stud 14 is provided at a point where the shear pocket 20 is located when the precast concrete slab 2 is placed. In other words, the stud 14 made of a rod member stands vertically and is fixedly installed at the upper surface of the upper beam 11. A thread may be formed at a top of the stud 14.

A support member 15 may be provided at the upper surface of the upper beam 11 so that the precast concrete slab 2 may be stably placed on the upper surface of the upper beam 11. In the embodiment depicted in the drawings, the support member 15 has a bent beam which has a bent section with a "¬" shape to have a horizontal portion and a vertical portion and extends in a bridge axis direction. A lower end of the vertical portion of the support member 15 is coupled and fixed to the upper surface of the upper beam 11. Two support members 15 make a pair and are respectively provided at both sides in a bridge transverse direction on the upper beam 11. A sealing member 150 such as a rubber plate may be disposed at an upper surface of the horizontal portion of the support member 15. The support member 15 may extend in a bridge axis direction all over the entire length of the upper beam 11.

The CFT truss girder 1 having the upper beam 11, the stud 14 and the support member 15 is pre-fabricated at a factory and installed at the casting bed 31. The precast concrete slab 2 is also produced in advance at a factory in a precast manner and then fabricated with the CFT truss girder 1 at the casting bed 31. FIG. 7 is a schematic perspective view showing a state where the precast concrete slab 2 is placed on the CFT truss girder 1, and FIG. 8 is a schematic perspective view showing a coupled portion of the precast concrete slab 2 and the CFT truss girder 1, at a section of the precast concrete slab 2 along a line E-E in FIG. 7. FIGS. 9 to 13 are schematic longitudinal sectional views showing a circle portion D of FIG. 8, observed in a direction of an arrow B, for sequentially illustrating a process of temporarily assembling the precast concrete slab 2 and the upper beam 11 of the CFT truss girder 1 with each other at a location where the shear pocket 20 is formed.

The precast concrete slab 2 is lifted by means of a lifting device such as a crane, and then installed on the upper beam 11 of the CFT truss girder 1 at the casting bed 31. If the precast concrete slab 2 is moved down on the CFT truss girder 1 as shown in FIG. 9, the precast concrete slab 2 is placed on the support member 15 as shown in FIG. 10, and the stud 14 of the upper beam 11 is inserted into the shear pocket 20 of the precast concrete slab 2. If the sealing material 150 is provided on the support member 15, when the precast concrete slab 2 is placed on the support member 15, the sealing material 150 makes the lower surface of the precast concrete slab 2 and the support member 15 be sealed in a watertight manner.

Subsequently, an extension rod 16 is coupled to the upper portion of the stud 14, an anchor plate 17 is installed at the upper surface of the precast concrete slab 2, and the upper portion of the extension rod 16 is coupled to the anchor plate 17. As shown in FIG. 11, the extension rod 16 is a rod member extending vertically and the extension rod 16 is screwed to the top of the stud 14. Before the precast concrete slab 2 is installed to the upper portion of the CFT truss girder 1, the extension rod 16 may be assembled to the stud 14 in advance. However, it is desirable that the extension rod 16 is assembled to the stud 14 after the precast concrete slab 2 is installed at the upper portion of the CFT truss girder 1 as described above.

Then, the anchor plate 17 is installed and coupled to the extension rod 16. The anchor plate 17 is placed on the upper surface of the precast concrete slab 2 to traverse the shear pocket 20. A through hole 170 is formed in the anchor plate 17. As shown in FIG. 12, in a state where the extension rod 16 is coupled to the stud 14, if the anchor plate 17 is placed on the shear pocket 20 and installed thereto, the upper portion of the extension rod 16 is inserted into the through hole 170 to move through the anchor plate 17, and the anchor plate 17 is placed on the upper surface of the precast concrete slab 2.

A coupling member 18 is coupled to the extension rod 16 formed through the anchor plate 17 and protruding on the upper surface of the anchor plate 17, as shown in FIG. 13. The coupling member 18 may be configured to give a pressing force so that the anchor plate 17 is pressed toward the upper surface of the precast concrete slab 2. For example, the coupling member 18 may be configured with a nut.

If the precast concrete slab 2 is installed on the CFT truss girder 1 as described above, the precast concrete slab 2 is supported by the support member 15, and the stud 14 is located in the shear pocket 20. In this state, if the extension rod 16 is coupled to the stud 14 and also the anchor plate 17 and the coupling member 18 are installed thereto, the CFT truss girder 1 and the precast concrete slab 2 are temporarily assembled. In other words, the CFT truss girder 1 and the precast concrete slab 2 are temporarily assembled to make a segment.

In a state where the CFT truss girder 1 and the precast concrete slab 2 are temporarily assembled, the CFT truss girder 1 and the precast concrete slab 2 are not perfectly integrated with each other, but when the segment is launched forwards, the CFT truss girder 1 and the precast concrete slab 2 move together. In particular, since the CFT truss girder 1 and the precast concrete slab 2 are temporarily assembled, it is possible to effectively prevent the lateral torsional buckling from occurring at the CFT truss girder 1 while the segment is being launched.

The CFT truss girder 1 includes the upper beam 11 and the lower beam 12 respectively located at upper and lower portions in a vertical direction, and also includes the web beams 13 connecting the upper and lower beams 11, 12 with each other. Therefore, if a force is applied to the CFT truss girder 1 in a vertical direction, the CFT truss girder 1 is likely to be distorted, which may generate lateral torsional buckling. FIG. 14 is a schematic sectional view corresponding to FIG. 10, showing a state where the upper beam 11 is rotated due to lateral torsional buckling occurring at the CFT truss girder 1 in a state where the stud 14 is inserted into the shear pocket 20. If the precast concrete slab 2 is placed on the CFT truss girder 1 but the stud 14 is simply located in the shear pocket 20, the stud 14 may freely move in the shear pocket 20. Thus, when the segment is being launched, the upper beam 11 may change its location as shown in FIG. 14, and thus lateral torsional buckling at the CFT truss girder 1 may be generated.

However, in the present disclosure, since the stud 14 is fixed by means of the extension rod 16, the anchor plate 17 and the coupling member 18 as shown in FIG. 13, the stud 14 cannot move in the shear pocket 20. Therefore, even though a force is applied to the CFT truss girder 1 in a vertical direction, the CFT truss girder 1 is not distorted. Thus, while the precast concrete slab 2 is installed to the CFT truss girder 1 to make a segment and the segment is launched forwards, it is possible to prevent lateral torsional buckling from occurring at the CFT truss girder 1.

Next, the work for integrally composing the CFT truss girder 1 and the precast concrete slab 2 in each segment and the work for integrally composing the precast concrete slabs 2 of segments in a longitudinal direction, performed in Step 7, will be described in detail.

In the present disclosure, since the stud 14 is fixed by means of the extension rod 16, the anchor plate 17 and the coupling member 18 as shown in FIG. 13, segments are launched forwards sequentially in a state where the CFT truss girder 1 and the precast concrete slab 2 are temporarily assembled.

If the plurality of segments are completely launched and thus disposed successively all over the entire span of the designed bridge, the coupling member 18, the anchor plate 17 and the extension rod 16 are dissembled and removed. If required, in order to further reinforce the role of the stud 14 as a shear connector, a head portion 140 having a greater diameter than the stud 14 may be assembled to the top of the stud 14 after the extension rod 16 is removed. FIG. 15 is a schematic sectional view corresponding to FIG. 10, showing a state where the head portion 140 is assembled to the stud 14.

A prestressing force is introduced to the precast concrete slab 2 in a bridge axis direction all over the entire span of the bridge to integrate the precast concrete slabs 2 of all segments. For this, when the precast concrete slab 2 is fabricated, a sheath pipe or the like may be buried in the precast concrete slab 2 in advance so that a tendon may be disposed therein.

After a prestressing force is introduced in a bridge axis direction to integrate the precast concrete slabs 2, the shear pocket 20 in which the stud 14 is located is filled with a grouting material 27. FIG. 16 is a schematic sectional view corresponding to FIG. 10, showing a state where the stud 14 is buried in the grouting material 27 by filling the shear pocket 20 with the grouting material 27. A space (an upper space of the upper beam) surrounded by the upper surface of the upper beam 11 and the support member 15 is formed below the shear pocket 20, and the shear pocket 20 is formed with a through hole whose upper and lower portions are opened, so that the upper space of the upper beam 11 communicates with the inside of the shear pocket 20. Therefore, if a grouting material 27 is poured into the shear pocket 20, the grouting material 27 also fills the upper space of the upper beam. In particular, if the support member 15 extends long in a longitudinal direction, the upper space of the upper beam also extends long in a longitudinal direction, and thus in this case, the grouting material 27 poured into the shear pocket 20 fills the upper space of the upper beam long in a longitudinal direction. The grouting material 27 fills the upper space of the upper beam 11 and the shear pocket 20 as described above and is cured, and the stud 14 is buried in the grouting material 27, so that the CFT truss girder 1 is coupled and completely integrated with the precast concrete slab 2.

As described above, in the present disclosure, a segment is fabricated using the CFT truss girder 1 and the precast concrete slab 2, such segments are successively disposed and the CFT truss girders 1 are connected in a bridge axis direction, and the segments connected to each other are launched forwards in order to construct a bridge. However, in the present disclosure, when the segments are launched, the CFT truss girder 1 and the precast concrete slab 2 are not yet perfectly coupled and integrally composed but are still in a temporarily assembled state. In this temporarily assembled state, while the segments are being launched, a tensile force applied to the CFT truss girder 1 is not transferred to the precast concrete slab 2. Therefore, when the segments are launched, it is possible to prevent an excessive tensile force from being applied to the precast concrete slab 2, and accordingly it is possible to effectively prevent the precast concrete slab 2 from being damaged by the tensile force.

In a state where the CFT truss girder 1 and the precast concrete slab 2 are temporarily assembled, the precast concrete slab 2 serves as a kind of bracing member to prevent lateral torsional buckling at the CFT truss girder 1. If only the CFT truss girder 1 is launched and then a slab is coupled to the CFT truss girder 1 after launching of the CFT truss girder 1, lateral torsional buckling is highly likely to occur at the CFT truss girder 1 while the CFT truss girder 1 is launched.

However, in the present disclosure, since the segment including the CFT truss girder 1 and the precast concrete slab 2 in a temporarily assembled state is launched, the precast concrete slab 2 suppresses lateral distortion of the CFT truss girder 1 while the CFT truss girder 1 is being launched. Therefore, in the present disclosure, it is possible to very effectively prevent the lateral torsional buckling from occurring at the CFT truss girder 1 during a launching process, thereby enhancing safety against the lateral torsional buckling.

In the embodiment of the present disclosure shown in FIGS. 1 to 3, the extrusion jack 39 is used as an extruding device for launching segments in order. However, when launching segments, a wire may also be used as an extruding device. Since a segment is fabricated using a lightweight CFT truss girder 1, the segment to be launched has a smaller weight in comparison to that used in a concrete bridge constructed by means of an existing ILM.

FIG. 17 is a schematic side view corresponding to FIG. 2B, showing that a first segment S1 and a second segment S2 are launched in a front direction by using a wire. FIG. 18 is a schematic enlarged view showing a circle portion E of FIG. 17, FIG. 19 is a schematic enlarged view showing a circle portion F of FIG. 17, and FIG. 20 is a schematic enlarged view showing a circle portion G of FIG. 17.

As shown in FIGS. 17 to 20, in order to launch segments by using a wire, a winch 55 is installed at the abutment 30 and/or the bridge pier 32. A cross beam 56 is installed at a rear end of a segment located at a rearmost side (the second segment in FIGS. 17 to 20). The cross beam 56 is simultaneously coupled and installed to a plurality of CFT truss girders 1 disposed in a transverse direction. A pulley 57 is provided at the cross beam 56. The wire 50 is wound on the pulley 57. Thus, if the winch 55 winds the wire 50, the wire 50 wound on the pulley 57 is pulled, and the segment is launched forwards. As described above, the segment may be easily launched forwards by using the wire 50, and in this case, the launching work may be more easily performed in comparison to the case using an extrusion jack.

As described above, in the bridge launching construction method according to the present disclosure, a precast concrete slab and a CFT truss girder fabricated at a factory are assembled at the casting bed to make each segment, and segments successively disposed are launched forwards to construct a bridge. Since main members of a superstructure of a bridge are pre-fabricated at a factory, works on the bridge construction site may be minimized, and thus it is possible to greatly shorten a construction period required for constructing the bridge, improve construction efficiency by means of mechanized construction, and ensure safety during a construction process.

In addition, in the present disclosure, the segment is launched in a state where the CFT truss girder and the precast concrete slab are "temporarily assembled". Thus, during the launching process, the precast concrete slab suppresses a lateral torsional buckling phenomenon caused at the CFT truss girder, and thus excellent stabilization may be ensured against the lateral torsional buckling.

In particular, in the bridge launching construction method according to the present disclosure, it is possible to construct a long-span bridge, and thus the present disclosure may be very usefully applied to a large bridge or a railway bridge which crosses an obstacle such as a river or a valley.

The invention claimed is:

1. A launching method of a bridge, which constructs a bridge to have a superstructure composed of a concrete filled steel tube (CFT) truss girder and a precast concrete slab, the launching method comprising:

placing a precast concrete slab on a CFT truss girder at a casting bed to fabricate a segment including the CFT truss girder and the precast concrete slab in a temporarily assembled state, successively disposing segments to connect CFT truss girders integrally with each other, and launching the segments in order in a front direction to form a superstructure of a bridge; and integrally composing the CFT truss girders and the precast concrete slabs after the segments are completely launched.

2. The launching method of a bridge according to claim 1, wherein a plurality of precast concrete slabs is successively disposed in a longitudinal direction at a single segment, and after the segments are completely launched, when the CFT truss girders and the precast concrete slabs are integrally composed, a prestressing force is applied to the plurality of precast concrete slabs in a longitudinal direction so that the precast concrete slabs are integrated with each other.

3. The launching method of a bridge according to claim 1, wherein the CFT truss girder includes an upper beam, a lower beam, and a web beam connecting the upper and lower beams, wherein a support member is provided at an upper surface of the upper beam to support the precast concrete slab, a shear pocket formed with a through hole is formed in the precast concrete slab at a location placed on the upper beam of the CFT truss girder, and a stud inserted into the shear pocket is provided at the upper beam, and wherein the process of temporarily assembling the CFT truss girder and the precast concrete slab by placing the precast concrete slab on the CFT truss girder includes placing the precast concrete slab on the support member so that the stud is inserted into the shear pocket, and coupling an extension rod to an upper portion of the stud and installing an anchor plate on an upper surface of the precast concrete slab so that the upper portion of the extension rod is coupled to the anchor plate.

4. The launching method of a bridge according to claim 3, wherein the process of integrally composing the CFT truss girders and the precast concrete slabs includes removing the extension rod and the anchor plate, and placing a grouting material in the shear pocket at which the stud is located so that the grouting material fills the upper space of the upper beam and the shear pocket and is cured.

5. The launching method of a bridge according to claim 4, wherein a through hole is formed in the anchor plate so that the extension rod passes therethrough, and wherein the process of coupling the upper portion of the extension rod to the anchor plate includes placing the anchor plate on the shear pocket in a state where the extension rod is coupled to the stud so that the upper portion of the extension rod is inserted into the through hole and thus the anchor plate passing through the anchor plate is placed on the upper surface of the precast concrete slab, and coupling a coupling member to the extension rod protruding on an upper surface of the anchor plate to press the anchor plate toward the upper surface of the precast concrete slab.

6. The launching method of a bridge according to claim 5, wherein when the CFT truss girder and the precast concrete slab are integrally composed, after the extension rod and the anchor plate are removed, a head portion is coupled to a top of the stud, and then the grouting material is placed in the shear pocket.

7. The launching method of a bridge according to claim 1, wherein the process of fabricating segments and launching the segments in order in a front direction to form a superstructure of a bridge includes:

placing a precast concrete slab on a CFT truss girder and temporarily assembling the precast concrete slab and the CFT truss girder to fabricate a first segment;

temporarily assembling a CFT truss girder and a precast concrete slab to fabricate a second segment, and disposing the second segment at the rear of the first segment to connect the CFT truss girders of the first and second segments;

pushing the first and second segments to be launched in a front direction; and fabricating an additional segment by temporarily assembling a CFT truss girder and a precast concrete slab, disposing the additionally fabricated segment at the rear of the segment located at a rearmost side, connecting CFT truss girders of the segments, and then pushing the segments to be launched in a front direction.

8. The launching method of a bridge according to claim 7, wherein a winch is installed at an abutment of the bridge, and wherein in the process of pushing the segments to be launched in a front direction, a cross beam having a pulley is installed at a rear end of the segment located at a rearmost side, a wire is wound around the pulley, and the winch winds the wire to pull the wire so that the segment is moved forwards.

* * * * *